United States Patent [19]

Weyer

[11] Patent Number: 4,496,143

[45] Date of Patent: Jan. 29, 1985

[54] SHEET FEEDER

[75] Inventor: Robert K. Weyer, Mercer Island, Wash.

[73] Assignee: EMF Corporation, Redmond, Wash.

[21] Appl. No.: 384,064

[22] Filed: Jun. 1, 1982

[51] Int. Cl.[3] ..... B65H 3/64

[52] U.S. Cl. ..... 271/112; 271/11; 271/161; 271/171

[58] Field of Search ..... 271/11, 12, 94, 96, 271/112, 30 A, 272, 171, 169, 161, 149, 150

[56] References Cited

U.S. PATENT DOCUMENTS

| | | | |
|---|---|---|---|
| 2,785,893 | 3/1957 | Ford | 271/169 |
| 3,185,472 | 5/1965 | Rubow | 271/11 |
| 3,198,514 | 8/1965 | Barbera | 271/94 |
| 3,391,926 | 7/1968 | Jaatinen | 271/112 |
| 3,687,448 | 8/1972 | Vora | 271/161 |
| 3,902,411 | 9/1975 | Gardner | 271/112 |

*Primary Examiner*—Douglas C. Butler
*Assistant Examiner*—John A. Carroll
*Attorney, Agent, or Firm*—David L. Garrison

[57] ABSTRACT

A sheet feeding apparatus including an air flow sheet separation mechanism for feeding individual sheets of paper from a stack of sheets slanted slightly from the vertical. A flow of air established through a plurality of resiliently surfaced feed wheels draws individual sheets seriatim from the nearly vertical stack of sheets into driving contact with feed rollers located adjacent the upper edge of the stack of sheets and mounted for rotation about a horizontal axis. Each sheet is then drawn upwardly by frictional contact with the feed rollers into the nip of a pair of opposed feed rolls which are mounted for rotation about a horizontal axis parallel to the feed wheel axis. The sheet is then delivered by conveyors to a sorting mechanism or other sheet fed device.

10 Claims, 5 Drawing Figures

SHEET FEEDER

BACKGROUND OF THE INVENTION

This invention relates to sheet feeding mechanisms and more particularly to a mechanism for feeding individual sheets seriatim from a nearly vertically oriented stack of sheets.

DESCRIPTION OF THE PRIOR ART

In printing devices or electrophotographic copier/duplicators it is common practice to provide a mechanism for feeding precut sheets from a stack one at a time. The sheet feeding apparatus may either be of the mechanical or the vacuum type. Mechanical feeding apparatus such as belt activated devices or wheel devices require frictional interaction with the sheet at the top or bottom of a substantially horizontally oriented stack of sheets to induce the sheet movement. Vacuum feeding apparatus on the other hand may use pneumatic forces in various configurations to engage individual sheets and induce movement of the sheet into the feeding mechanism. Oscillating vacuum feeders in which a feeding foot movable to engage the top sheet of a stack of sheets is a frequently used expedient and serves to pick up individual sheets from the stack. The problem with oscillating type feeders is their relative slowness and tendency to create excess static charge on the sheets. An example of oscillating vacuum feeders are shown in U.S. Pat. Nos. 2,770,458 and 3,764,255. Such apparatus required a relatively complex configuration requiring complicated pneumatic shut-off valves or intricate internal valve construction within the oscillating vacuum feeder housing. Other feeders are known which combine the pneumatic and mechanical systems and otherwise seek to separate the sheets for individual feeding with varying degrees of success.

SUMMARY OF THE INVENTION

It is an object of this invention to provide a simplified high speed sheet feed mechanism for individually feeding the topmost sheet from a stack of substantially vertically oriented sheets.

It is another object of this invention to provide a sheet feeding mechanism which imparts a minimum of static electricity to sheets as they are individually fed to a sheet receiving mechanism.

It is a further object of this invention to provide a sheet feed device in which a stack of sheets are advanced toward a feeding station in a nearly vertical attitude from which sheets are individually separated from the pack of sheets and extracted therefrom by a flow of air across the top edge of the pack of sheets which draws only the topmost sheet into contact with a drive mechanism.

The paper feeding mechanism of this invention feeds sheets of paper from a stack of sheets oriented at approximately 10° back from the vertical from a paper tray which advances towards the feed mechanism as the paper sheets are removed from the top of the stack. The tray is mounted for substantially horizontal movement on support means positioned near the bottom of the feeder. The paper tray is urged toward the feed drive wheels until the exposed face of the stack of paper engages a limit switch set to position the topmost sheet within a short distance from the feed drive wheels. The limit switch and the drive mechanism for the paper tray are preferrably both positioned near the bottom of the feed mechanism chassis. The paper stack advances toward a set of feed drive wheels which are mounted for rotation about a horizontal axis, the axis being parallel to the plane of the advancing sheets. Air flow is induced between the feed drive wheels by a plenum and fan and causes the topmost sheet of the advancing pack to individually lift from the surface of the remaining sheets and engage the elastomer surface mounted on each of the individual feed drive wheels. The frictional contact of the single topmost sheet of paper against the elastomer surface induced by continued air flow is sufficient to cause upward movement of the topmost sheet onto a feed path. The sheet is extracted from the pack of sheets and moved upwardly past a guide means which in concert with the air flow mechanism directs the sheet into the nip of a pair of opposed feeding rolls. One of the rolls may have at least one O-ring mounted as a tire on the roller to enhance frictional contact with the sheet and minimize static. From the feed rolls the paper is passed through a doubles detector and deposited onto the perforated moving web of a volume air flow type paper conveyor. The sheet then is transferred into the interface mechanism of a sorting device or other sheet fed mechanism.

Feeding can be interrupted momentarily by projecting a clutch mechanism comprising a paper pack engaging arm into contact with the paper pack to prevent the topmost sheet from lifting from the pack into engagement with the feed drive wheels. Alternatively, the feed can be interrupted by ceasing air flow or the rotation of the feed drive wheels stopped.

DESCRIPTION OF THE PREFERRED EMBODIMENT

Figure 1:
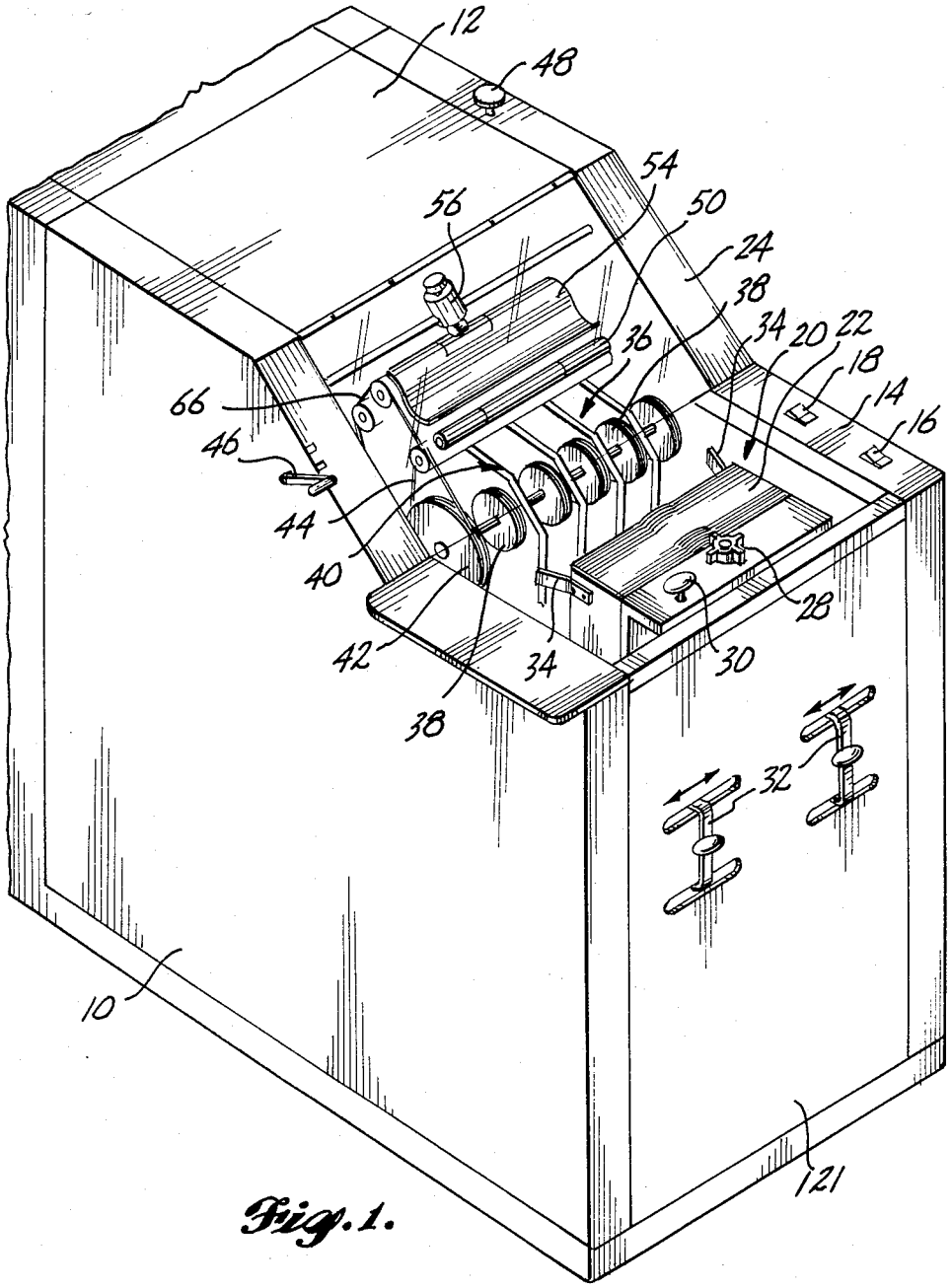
FIG. 1 is a perspective view of the sheet feeding mechanism.

Referring now to the drawings, wherein like numerals indicate like parts, a paper sheet feeder of the type of this invention is shown in FIGS. 1–5. The perspective view of FIG. 1 shows the cabinet 10 which houses the feed mechanism. On the upper surface of the cabinet there is an electrical control panel 14 having a power switch 16 to control the supply of electrical power to the apparatus and a clutch switch 18 which is adapted to control the paper clutch described in detail below. A paper tray 20 is adapted to receive a plurality of paper sheets on end positioned in the paper tray 20 and angled slightly, preferrably about 10°, toward the front 121 of cabinet 10. The stack of paper 22 sits in paper tray 20 on its end with an upper feed edge **22*a* of the topmost sheet being accessible to the feed mechanism. An inclined cover plate 24 slopes upwardly from the control panel 14 toward the top 12** of the cabinet. The central feed area of the cabinet is closed by a transparent hinged cover 26 adapted to be swung up out of the way for access to the feeding mechanism.

Figure 3:
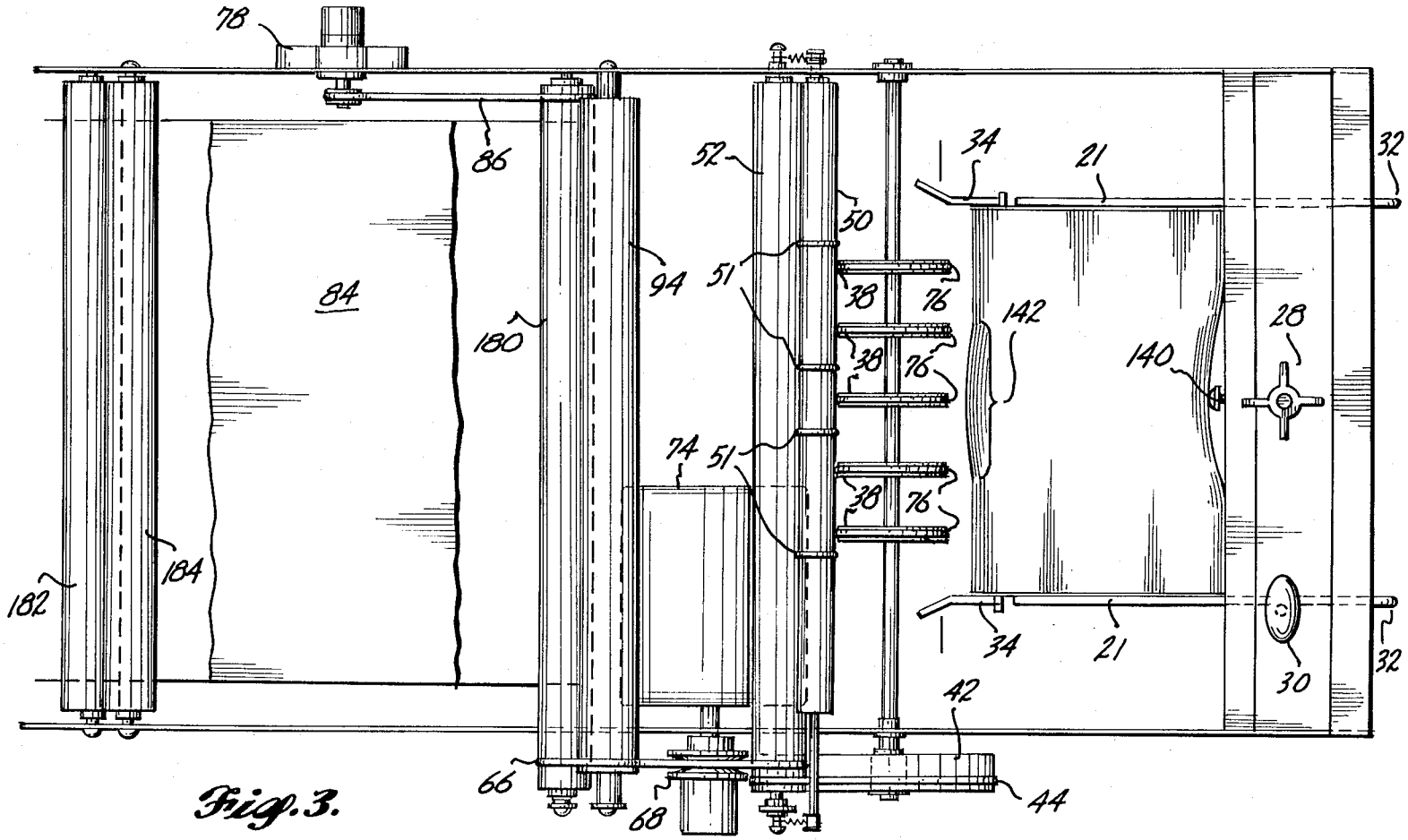
FIG. 3 is a plan view of the apparatus of this invention.

Controls are provided to adjust the location of the stack of sheets 22. A height adjustment 28 is provided raising and lowering of the stacks to adjust for different lengths of paper. A stack advance release control 30 is connected to the stack advance mechanism which is described below to provide means to move the stack forward into proximity of the feed drive wheels 38. Various widths of sheets can be accommodated by adjustment of the sheet width controls 32. Paper retainers 34 are provided at each upper corner of the paper tray to aid in separating the topmost sheet from its immediately adjacent neighbor and to aid in feeding of the sheets as is described at length below. The paper retainers 34 are advantageously surfaced with cork or other suitable nonslip material. As best seen in FIG. 3, Pin 140, located at the back of paper tray 20, produces a slight bow 142 in the stack of sheets 22.

A plurality of feed drive wheels 38 are shown positioned adjacent the stack of sheets 22. These drive wheels have an elastomeric band commonly known as an O-ring fitted into the periphery thereof in a peripheral recess so that sheets drawn against drive wheels 38 will touch only the elastomer surface. Apertures defined by a plenum 80, 81 permit air to flow between the drive wheels 38. A plurality of lift off bars 40 are provided to disengage paper from drive wheels 38, the paper having been urged against the drive wheels by flow of air through the aforementioned apertures. A larger diameter drive pulley 42 is provided to receive rotative power through drive belt 44. Drive belt 44 is trained about the periphery of drive pulley 42 and lower nip roller 52. Power from motor 74 is applied to roller 52 by belt 66. The paper path leaving drive wheels 38 progresses toward a pair of opposed nip rollers 50 and 52. Lower nip roller 52 is driven by drive belt 66 and upper nip roller 50 receives rotative motion from roller 52. Rubber tires or O-rings 51 may be used to insure no damage is done to the paper passing through the rolls and to provide positive traction. A sheet exiting nip rollers 50 and 52 is guided into a doubles detector 56 by shaped guide 54. Doubles detector 56 is adapted to sense the passage of more than one sheet of paper at a time and is of the mechanical type in which a gap permitting transit of a single sheet but detecting the presence of more than one sheet is used. Roller 94 also powered by belt 66 travels at substantially the same rate of rotation as nip roller 52 so that paper is moved through the mechanism at a constant rate of speed.

Upon exiting the doubles detector 56 the paper is deposited upon a volume air flow conveyor mechanism comprising an upper transport roller 180, a lower transport roller 182 and idler roller 184 and a perforated or porous belt 84 trained about upper and lower transport rollers 180 and 182 respectively. Upper transport roller 180 receives power from belt 66 and provides a linear speed substantially equal to the speed imparted the sheets by nip rollers 50 and 52. Transport means is provided for sheets to be delivered to a sheet fed mechanism such as a sorter through an aperture (not shown) in the cabinet 10 positioned adjacent the lower transport roller 182. Air is caused to gently flow through the porous belt 84 of the volume air flow transport 82 by operation of blade fan and motor 90 which exhausts the air flow to the outside of the cabinet through conduit 92. Plenum 88 is provided surrounding the transport mechanism with the upper run of porous belt 84 exposed to receive the sheet of paper being transported.

Plenum elements 80 and 81 serve to define a passageway for the flow of air which is exhausted by use of squirrel cage fan 78. The air enters through the aperture 36 and the gentle flow of air past the leading edge of the topmost sheet of paper on stack 22 causes the topmost sheet to be bent over and drawn into contact with the drive wheel O-rings 76.

Figure 4:
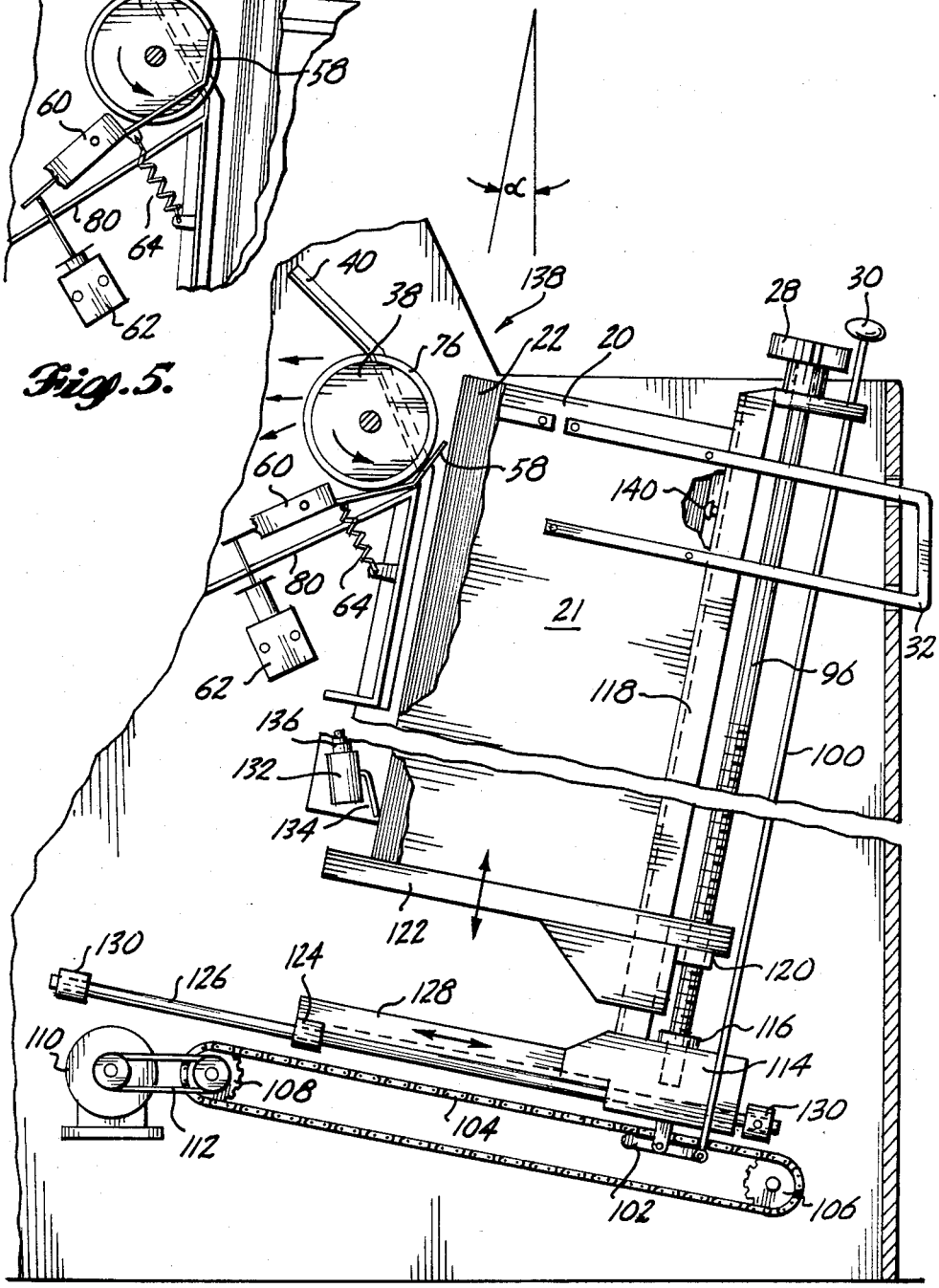
FIG. 4 is an enlarged side elevational view of a portion of apparatus showing the paper feed magazine and feeding station.

The paper tray adjusting and advancing mechanism is best seen in FIG. 4. Tray 20 has sides 21, table support 122 and a rail 118 adapted to rigidly support and position the stack of sheets 22. Paper tray 20 rides on a lower base frame 128 which is journaled at 124 and 114 for sliding movement upon rod 126. Rod 126 (one of which is positioned at each side of paper tray 20) is supported from a bottom frame (not shown) of cabinet 10. Journal 114 also includes a mounting mechanism for pivital mounting of a paper advance release dog 102. Dog 102 engages drive chain 104 which is operated by a gear reduced motor 110 through belt 112 to move at a very slow pace causing the paper tray 20 to advance towards feed wheels 38 whenever dog 102 is engaged into chain 104. The chamfered front surface of dog 102 permits paper tray 20 to be ratcheted forward but hooks and securely engages chain 104 to prevent paper tray 20 from sliding away from feed wheels 38. Dog 102 may be disengaged by raising knob 30 which is connected to dog 102 by rod 100.

The location of the top sheet of the pack of sheets 22 is governed by limit switch 132 which interrupts the circuit to motor 110 whenever the front of the pack of papers 22 engages sensor arm 134. Limit switch 132 is mounted on transversly positioned limit switch support 136 which is firmly attached to the cabinet 10.

The table 122 of paper tray 20 may be raised and lowered by rotation of paper stack height adjustment mechanism 28. Paper height control shaft 96 is journaled into the top surface of base journal 114 for rotation and is located at the position shown by collar 116. The paper height control shaft 96 is also threadingly engaged with threaded bushing 120 to cause table 122 to raise and lower upon rotation of paper height control shaft 96. As shaft 96 is rotated paper tray 122 travels upwardly on support rail 118 to the desired position as shown in FIG. 4 with the leading edge of the stack of paper 22 in close proximity to feed wheels 38.

Figure 5:
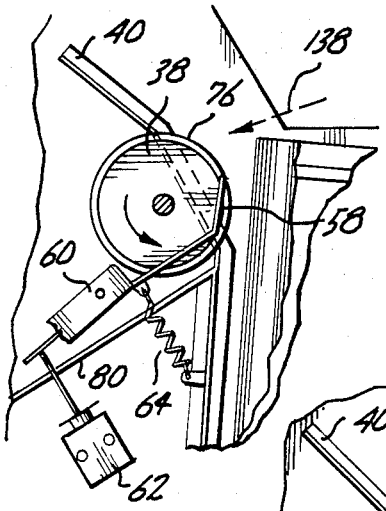
FIG. 5 is a view like FIG. 4 with the paper clutch retracted to permit feeding of sheets.

A paper engaging clutch or arm 58 is adapted to prevent feeding of the sheets whenever arm 58 is positioned in the location shown in FIG. 4. When retracted, as shown in FIG. 5, by activation of solenoid 62, the first sheet of the stack of sheets 22 may be removed from the stack of sheets 22 by the feeding mechanism.

OPERATION OF FEEDER MECHANISM

Figure 2:
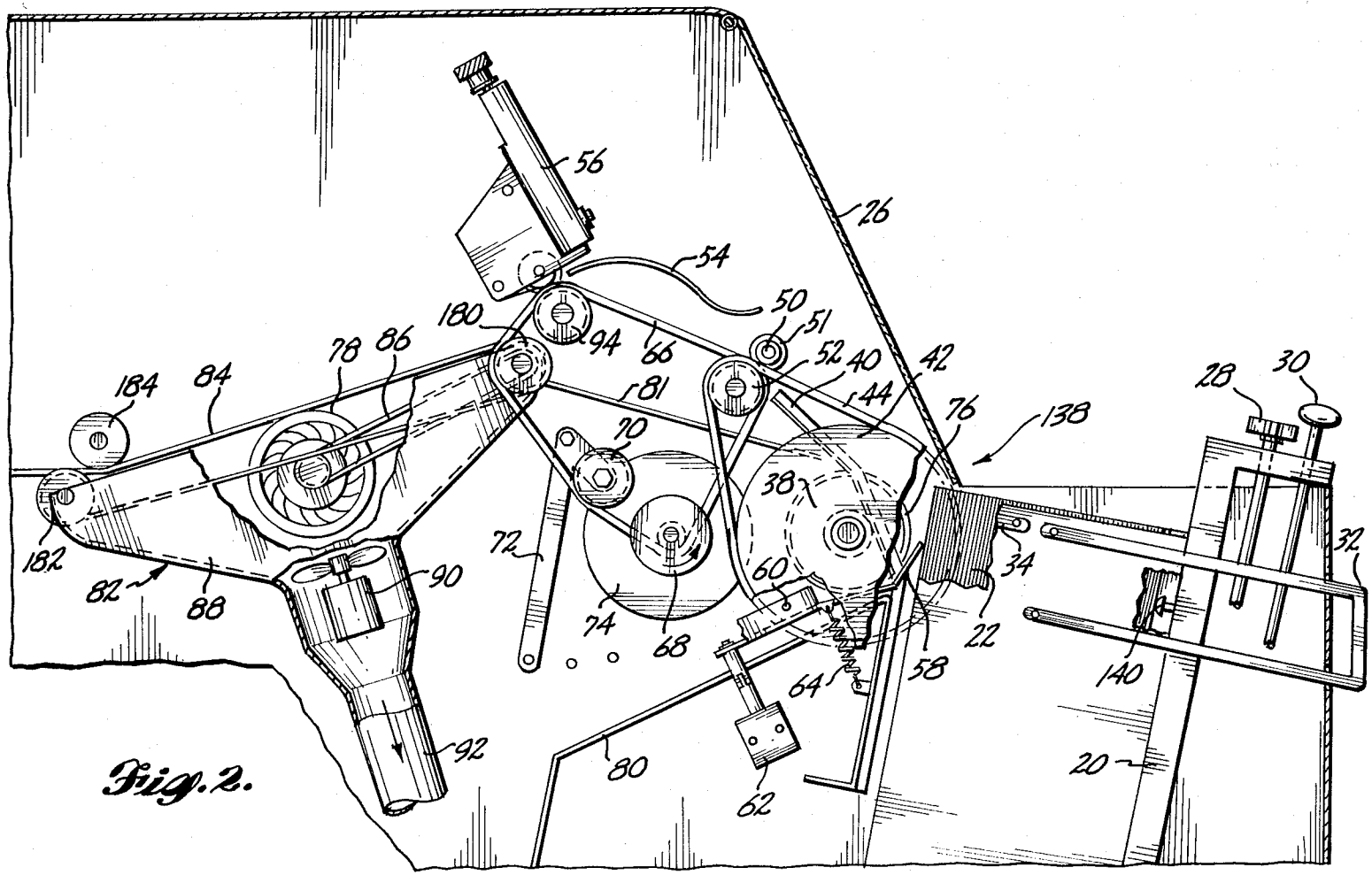
FIG. 2 is a side elevational view of the apparatus shown in FIG. 1 with the side panel removed to expose interior parts of the sheet feeding mechanism.

In operation the mechanism is prepared for feeding sheets by first retracting the paper tray 20 to its position substantially as shown in FIG. 4 retracted from feed roll 38. The desired number of sheets are placed in tray 20 and the tray is advanced by either raising paper stack advance release 30 or by simply pushing forward on the paper tray 20 causing dog 102 to ratchet along chain 104. When the topmost sheet of the stack of sheets 22 reaches the position shown in FIG. 4 the height of the tray is then adjusted so that the leading edge of the topmost sheet will be positioned in the feeding location as shown in Figs. 4 and 5. The adjustment for height is made by turning paper stack height adjustment control 28 one direction or the other in order to raise or lower the top edge of the stack of sheets. With the paper stack now in the feed position, power to the mechanism is started by closing switch 16. This starts motor 74 which provides power to the feed rolls, feed wheels and other rotating devices described in this invention. Power is supplied through variable speed pulley 68 to belt 66, the tension on belt 66 being set by positioning idler 70 at any desired location to tension belt 66. The speed of the mechanism is set by adjusting control 46. The volume of air flow past feed rolls 38 is then adjusted by setting control 48 to regulate the outlet cross section of squirrel cage fan 78. Air flow, induced by squirrel cage fan 78, flows inwardly past the stack of sheets as shown at arrow 138 which flow tends to separate the topmost sheet from the angled stack of sheets urging that topmost sheet toward the feed drive wheels 38. Paper clutch 58 still engages the topmost sheet of stack 22 and effectively prevents feeding of the topmost sheet. Power is also provided to motor 90 in order to induce air flow through volume air flow transport conveyor 82. With the mechanism running paper clutch 58 is withdrawn to the position shown in FIG. 5 by activating switch 18. The topmost sheet of paper is immediately drawn into contact with the elastomer O-rings 76 positioned on the periphery of feed drive wheels 38. The air flow as represented by arrow 138 causes the topmost sheet to firmly engage in driving relation the periphery of drive wheels 38 and the frictional contact therebetween induces motion lengthwise of the topmost sheet along the feed path. The presence of the topmost sheet laid against drive wheel 38 also effectively closes off a substantial portion of the air flow apertures through which air flow 138 traverses. As a result the tendency for subsequent sheets to be bent over into contact with the drive wheels 38 is momentarily lessened, until the sheet has been fed past drive wheels 38. As the sheet is withdrawn from the stack and the leading edge thereof moves about the periphery of wheels 38 the sheet will engage lift off bars 40, separating the sheet from the periphery of drive wheels 38. The sheet is then fed along the path as best seen in FIG. 2 into the nip of rollers 50 and 52. The rollers 50 and 52 serve to positively feed the paper along its path into the sheet fed mechanism. Exiting nip rollers 50 and 52 the paper encounters guide 54 which urges the paper into doubles detector 56 and then onto transport 82 to be fed from there into an adjacent sheet fed mechanism.

As soon as the sheet being fed from the stack of sheets 22 clears drive wheels 38 the air flow 138 is resumed, causing the then topmost sheet of stack 22 to bend over and engage drive wheels 38. The above described process continues seriatim, feeding sheets at a controllable and positive rate to a sheet fed mechanism. As sheets are withdrawn from stack of sheets 22 the limit switch 132 will be activated causing gear motor 110 to operate chain 104 thereby causing the tray 20 to move upwardly along rods 126, until limit switch 132 is again opened by engagement of arm 134 with the front surface of stack of sheets 22.

Feed may be interrupted at any time by stopping the flow of air through and between drive wheels 38 or by extending the paper clutch 58 into engagement with the topmost sheet of the stack of sheets 22.

While the invention has been described in terms of a preferred embodiment, it is to be understood that alternative structures and equivalent devices may be contemplated by one of ordinary skill in the art which are within the scope of the invention as claimed below.

I claim:

1. A feed mechanism for feeding sheets seriatim from a stack of sheets comprising;

tray means for receiving a stack of sheets with said sheets positioned in a plane angled slightly from the vertical and with a top edge of said stack exposed;

feed drive wheels mounted for rotation about an axis substantially parallel to said plane; and means to induce an air flow to pass first across the top edge of said stack and thence through said feed drive wheels whereby the top portion of the first front sheet from said stack is bendingly urged forward by said air flow into engagement with said feed drive wheels for removal of said first front sheet from said stack, said induced air flow across the top edge of said stack being temporarily and substantially interrupted by the first front sheet's full engagement with said feed drive wheels whereby the next front sheet of said stack remains quiescent until said first front sheet begins its disengagement from said feed drive wheels, thereby allowing the induced air flow to again begin to pass across the top edge of said stack.

2. The apparatus of claim 1 wherein said tray means includes means to advance said stack toward said feed drive wheels as sheets are removed from said stack.

3. The apparatus of claim 1 wherein said tray means is height adjustable to accommodate various sheet dimensions.

4. The apparatus of claim 1 further including sheet lift means interposed between said feed drive wheels to strip said sheet from said feed drive wheels and guide said sheet onto a sheet feed path.

5. The apparatus of claim 4 and opposed drive rollers for receiving said sheet from said sheet lift means and moving said sheet along said feed path.

6. The apparatus of claim 1 wherein said tray has resilient surfaced side guides at the top of said stack.

7. The apparatus of claim 1 and means on said tray to bow the stack of sheets.

8. The apparatus of claim 1 wherein said angle slightly from the vertical is approximately 10°.

9. The apparatus of claim 1 and clutch means extendable from between said feed drive wheels into contact with said stack of sheets to interrupt feeding thereof.

10. The apparatus of claim 1 wherein a plenum partially encloses said feed drive wheels with apertures for air flow opening between said feed drive wheels to direct said air flow between said wheels.

* * * * *